United States Patent [19]

Kamp et al.

[11] Patent Number: 4,635,866

[45] Date of Patent: Jan. 13, 1987

[54] APPARATUS FOR AUTOMATICALLY LIFTING A CROSS-WOUND BOBBIN FROM ITS DRIVE DRUM

[75] Inventors: Heinz Kamp, Wegberg; Rolf Becker, Monchen-Gladbach, both of Fed. Rep. of Germany

[73] Assignee: W. Schlafhorst & Co., Monchen-Gladbach, Fed. Rep. of Germany

[21] Appl. No.: 707,699

[22] Filed: Mar. 4, 1985

[30] Foreign Application Priority Data

Mar. 2, 1984 [DE] Fed. Rep. of Germany ..... 3407766

[51] Int. Cl.[4] ..... B65H 63/00

[52] U.S. Cl. ..... 242/36; 242/37 R; 242/39

[58] Field of Search ..... 242/36, 37 R, 38, 39, 242/40, 49, 18 DD

[56] References Cited

U.S. PATENT DOCUMENTS

| | | | |
|---|---|---|---|
| 1,958,060 | 5/1934 | McKean | 242/37 R |
| 3,282,517 | 11/1966 | Chavis | 242/37 R |
| 3,481,550 | 12/1969 | Chavis | 242/37 R |
| 3,490,709 | 1/1970 | Siegenthaler | 242/37 R |
| 4,149,679 | 4/1979 | Trost | 242/36 |
| 4,195,790 | 4/1980 | Reiners et al. | 242/37 R |
| 4,332,065 | 6/1982 | Hauri | 242/36 X |
| 4,497,451 | 2/1985 | Guggemos et al. | 242/37 R |

FOREIGN PATENT DOCUMENTS

| | | | |
|---|---|---|---|
| 868867 | 3/1953 | Fed. Rep. of Germany | 242/39 |
| 912195 | 5/1954 | Fed. Rep. of Germany | 242/37 R |
| 806754 | 10/1936 | France | 242/37 R |
| 1212510 | 10/1959 | France | 242/37 R |
| 598006 | 9/1959 | Italy | 242/37 R |
| 37662 | 9/1972 | Japan | 242/39 |

*Primary Examiner*—Stanley N. Gilreath

*Attorney, Agent, or Firm*—Herbert L. Lerner; Laurence A. Greenberg

[57] ABSTRACT

Winding device for cross-wound bobbins, including a winding frame rotatably supporting a bobbin, a drive drum for rotating the bobbin, and a drive for rotating the drive drum, the improvement including an apparatus for automatically lifting the bobbin from the drive drum upon the stoppage of the drive, the lifting apparatus including a disconnection device being connected to the drive and being switchable into different switching states for controlling the drive dum, a device for lifting the winding frame being connected to the disconnection device and being controlled in dependence on the switching state of the disconnection device, and a coupling having a first coupling element connected to the winding frame, a second coupling element connected to the frame lifting device, and a control element controllable by the frame lifting device for separating and joining the coupling elements.

8 Claims, 5 Drawing Figures

APPARATUS FOR AUTOMATICALLY LIFTING A CROSS-WOUND BOBBIN FROM ITS DRIVE DRUM

The invention relates to an apparatus for the automatic lifting of a cross-wound bobbin or cheese from its drive drum, upon the failure or stoppage of the drive of the drum, the bobbin being rotatably supported in a winding frame of a device for winding cross-wound bobbins.

If the drive drum in a winding device for cross-wound bobbins stops or is turned off, the bobbin conventionally remains on the drive drum and continues to rotate until the drive drum comes to a stop. A brake may therefore be used, but it must not be too strong otherwise the surface of the cross-wound bobbin will be damaged. In some cases, the bobbin slides or slips on the drive drum causing errors in the thread layers and damage to the thread, which cannot be repaired. It is also possible to accelerate the stoppage of the cross-wound bobbin and its drive drum by braking the drive drum and the bobbin simultaneously. However, the adjustment of the two brakes cannot be achieved simply, and the above-mentioned damage still occurs.

It is accordingly an object of the invention to provide an apparatus for automatically lifting a cross-wound bobbin from its drive drum, which overcomes the hereinafore-mentioned disadvantages of the heretofore-known devices of the general type, and to ensure that after the drum drive is stopped or turned off, the cross-wound bobbin does not become damaged, but rather that the separate and rapid braking of the motion of the cross-wound bobbin is simultaneously permitted.

With the foregoing and other objects in view, there is provided, in accordance with the invention, in a winding device for cross-wound bobbins, including a winding or spool frame rotatably supporting a bobbin, a drive drum for rotating the bobbin, and a drive for rotating the drive drum, the improvement comprising an apparatus for automatically lifting the bobbin from the drive drum upon the stoppage or failure of the drive, the lifting apparatus including a disconnection device being connected to the drive and being switchable into different switching states for controlling the drive drum, a device for lifting the winding frame being connected to the disconnection device and being controlled in dependence on the switching state of the disconnection device, and a coupling having a first coupling element connected to the winding frame, a second coupling element connected to the frame lifting device, and a control element controllable by the frame lifting device for separating and joining the coupling elements.

In an advantageous way, the winding frame can freely move during the winding operation. It is not obstructed by the frame lifting device. However, the frame lifting device is always in readiness to operate, and becomes active as soon as the drive of the drum fails, or is turned off. The frame lifting device is coupled to the winding frame, in dependence on the disconnection device of the drive drum, and can then lift the winding frame a certain distance or angle from its respective position. Therefore, the cross-wound bobbin and the drive drum are separated from each other and can be subsequently braked separately or run-out freely. Damage to the cross-wound bobbins cannot occur. Without the measures taken according to the invention, damage can occur with sensitive, fine threads, even when letting the drive drum run out freely, due to the different mass inertia moments of the bobbin and the drum. This is completely avoided by the invention.

In accordance with another feature of the invention, the coupling elements have sets of teeth engageable with each other.

In accordance with a further feature of the invention, the first coupling element is a pivotable toothed pawl, the second coupling element is a toothed circular segment, and the control element is an arcuate toothed pawl rejector disposed parallel to the circular segment.

In accordance with an additional feature of the invention the frame lifting device includes a lifter element having at least a part thereof connected to the toothed pawl rejector, the winding frame has a pivot axis, the toothed circular segment has a center pivotally supported at the pivot axis of the winding frame, and including a joint connecting the toothed circular segment to the lifter element.

In accordance with a contomitant feature of the invention the winding frame includes an arm facing away from the bobbin on which the toothed pawl is pivotably supported; the lifter element being lifted by the coupling during winding of the bobbin so far that the toothed pawl rejector prevents engagement of the toothed pawl in the teeth of the circular segment; and the lifter element being lowered after the drive stops or fails so far that the toothed pawl rejector is non-functional, the toothed pawl is engaged in the teeth of the circular segment, and the winding frame is lifted to a raised position and the bobbin is brought out of contact with the drive drum, due to the connection between the lifter element and the arm.

In accordance with still a further feature of the invention the toothed pawl has a knife-type edge which is dimensioned for covering the teeth of the circular segment and the toothed pawl rejector, permitting the toothed pawl rejector to directly contact the toothed pawl.

In accordance with yet an additional feature of the invention, there is provided another control element disposed alongside and connected to the toothed pawl, the other control element contacting the toothed pawl rejector upon operation of the toothed pawl rejector.

In accordance with another contomitant feature of the invention, there is provided a parallel displacement device connecting the toothed pawl rejector to the toothed circular segment and the toothed pawl rejector has a lever contacting the frame lifting device.

Other features which are considered as characteristic for the invention are set forth in the appended claims.

Although the invention is illustrated and described herein as embodied in an apparatus for automatically lifting a cross-wound bobbin from its drive drum, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
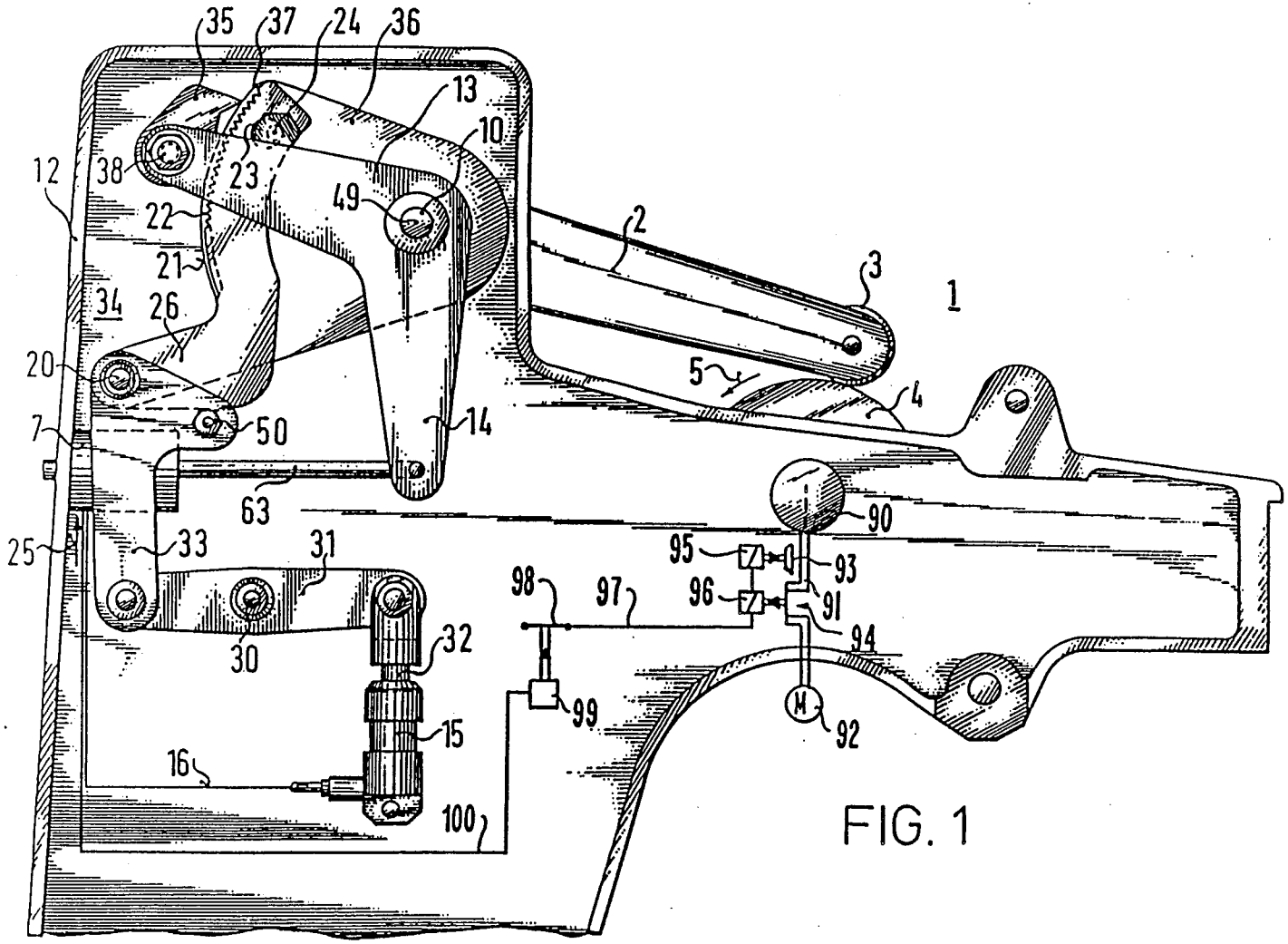
FIG. 1 is a fragmentary, diagrammatic, side-elevational view of a winding device for cross-wound bobbins or cheeses, including a winding frame, a cross-wound bobbin and a frame lifting mechanism.
Figure 2:
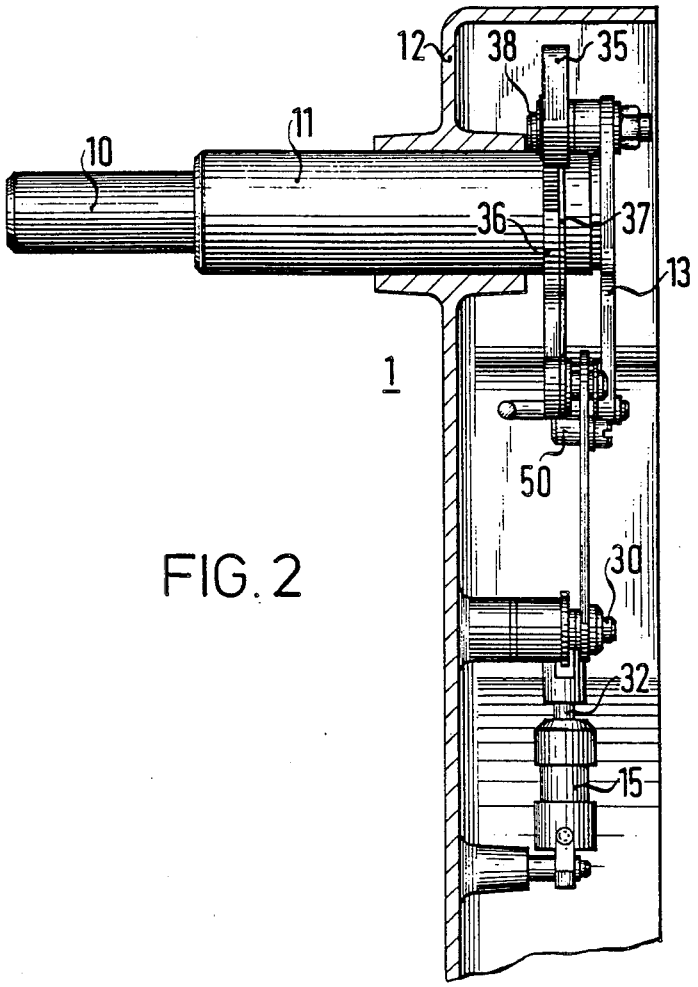
FIG. 2 is a fragmentary cross-sectional view of the frame lifting device.

Referring now to the figures of the drawings in detail and first particularly to FIGS. 1 and 2 thereof, there is seen a device 1 for winding cross-wound bobbins or cheeses, and a cross-wound bobbin or cheese 3 which is rotatably supported in a winding frame 2. The bobbin 3 lies on a drive drum 4 which drives the bobbin 3 by friction. The drive drum 4 rotates in the direction of the curved arrow 5.

The winding frame 2 has a pivot axis 10, which is rotatably supported in a pivot bearing 11. The bearing 11 is fitted into a housing 12 of the device 1 for winding cross-wound bobbins.

The winding frame 2 is provided with an arm 13, which is fastened to the pivot axis 10 and is directed backward. A control arm 14 also extends downward from the arm 13.

A lifting device 15 for the winding frame 2 is provided in the housing 12 in the form of a pneumatic piston-cylinder assembly. A rocker arm 31 is supported on an axis 30 above the frame lifting device 15. One side of the arm 31 is connected by a piston rod 32 to the frame lifting device 15, and the other side of the arm 31 is connected to a coupling 34 by a lifter element 33.

The coupling 34 is formed of a first coupling element 35 in the form of a toothed pawl, a second coupling element 36 in the form of a toothed circular segment, and a control element 37 serving as a toothed pawl rejector for separating and joining the coupling elements 35, 36. The toothed pawl 35 is supported on a pivot axis 38 on the arm 13.

The toothed pawl rejector 37 is connected by a joint 20 with the lifting element 33 of the frame lifting device 15.

The center 49 of the toothed circular segment 36 is pivoted in the pivot axis 10 of the winding frame 2. The position of the circular segment 36 is determined by the articulation joint 20.

FIG. 1 shows that the set of teeth of the segment 36 follows a circular arc, which has its center at reference numeral 49. The contour 21 of the toothed pawl rejector 37 is also a circular arc and has the same radius of curvature as teeth 22. A projection 26 of the pawl rejector 37 is also connected with the lifting element 33 through the joint 20. The toothed pawl rejector 37 is provided with an elongated hole 23. A guide pin 24 which is engaged in the hole 23 is fastened to the circular segment 36.

FIG. 1 relates to the winding operation. The cross-wound bobbin 3 lies on the rotating drive drum 4. The coupling 34 is in the decoupled state. The lifter element 33 is lifted in the direction of the arrow 25 far enough so that the toothed pawl rejector 37 prevents the engagement of the toothed pawl 35 in the teeth 22 of the circular segment 36. This is effected by a stop 50 which has lifted the projection 26.

During the winding of the cross-wound bobbin 3, the winding frame 2 slowly swings up counterclockwise. The motion of the arm 14 is transmitted to a control shaft 63 which ends at a disconnection device 7. As soon as the cross-wound bobbin 3 has reached a predetermined diameter, the control rod 63 operates the disconnection device 7, with the result that the drive drum 4 is stopped. At approximately the same time, or slightly before, the frame lifting device 15 is turned on through a functional or operative connection 16.

The drive drum 4 has a hub 90 which is driven by a drive motor 92 through a drive shaft 91. The drive drum 4 is stopped when the disconnection device 7 signals a relay 99 through an operative connection 100. The relay opens a contact 98 connected to a magnetic clutch drive 96 and a brake releasing magnetic drive 95 through a line 97. When the contact 98 opens, the drives 95 and 96 become currentless, pushing a brake 93 against the shaft 91 and disengaging a magnetic clutch 94, so that the drive drum 4 stops rotating.

Referring to the structure according to FIG. 1, the following operation takes place:

The lifting element 33 moves downward against the direction of the arrow 25. The pawl rejector 37 swings to the right, so that the toothed pawl 35 engages the teeth 22 of the circular segment 36.

The circular segment 36 therefore swings counter clockwise around the center 49 and during this motion it takes along the toothed pawl 35 and the arm 13. The arm and the winding frame therefore swing counter clockwise and the cross-wound bobbin 3 is lifted from the drive drum 4. The swinging motion is continued until the desired spacing of the cross-wound bobbin 3 from the drive drum 4 is reached.

The disconnection device 7 can also be operated manually or by a thread monitor or a thread cleaning device, besides by the control arm 14. Therefore, if the running of the thread is interrupted, or becomes interrupted, this depends on the reason for the interruption of the drive.

Figure 3:
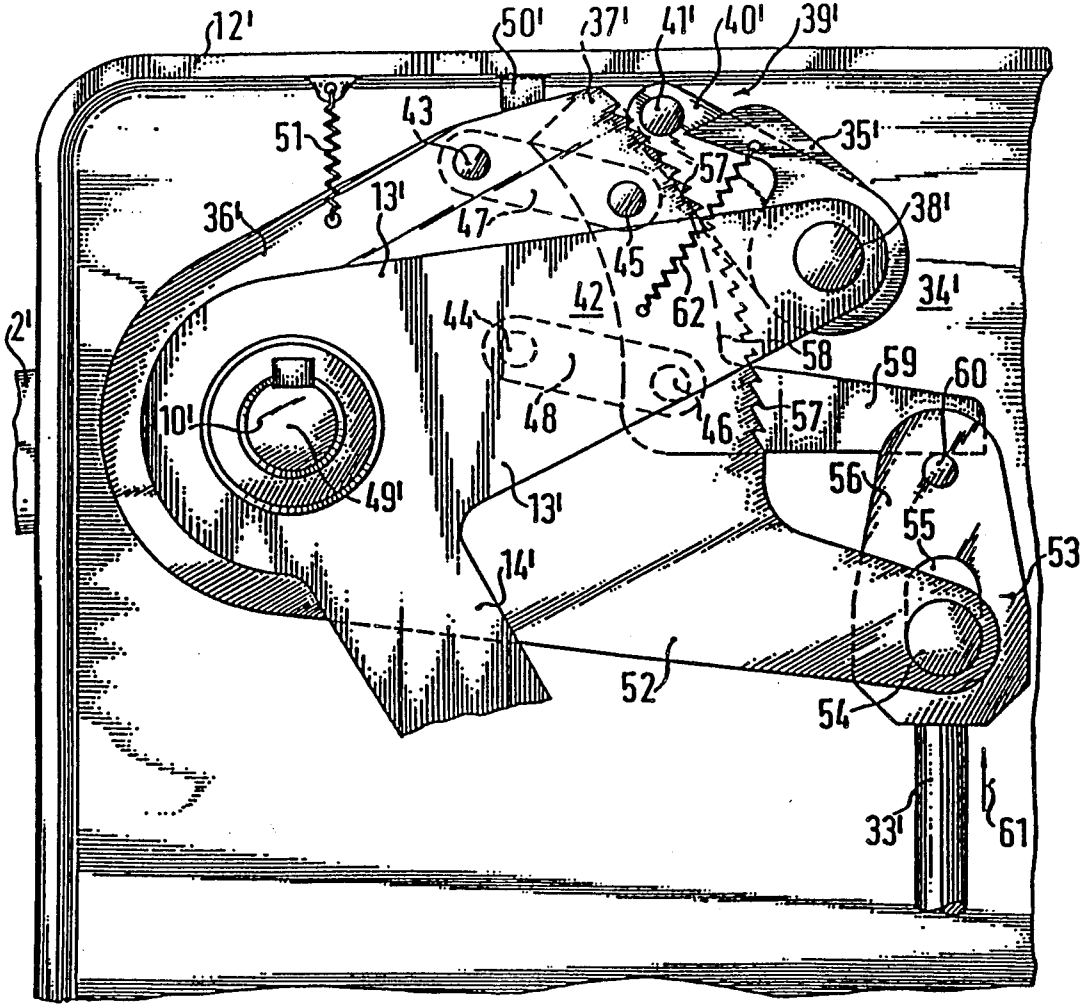
FIG. 3 is a fragmentary side-elevational view of another embodiment of the device according to the invention.
Figure 4:
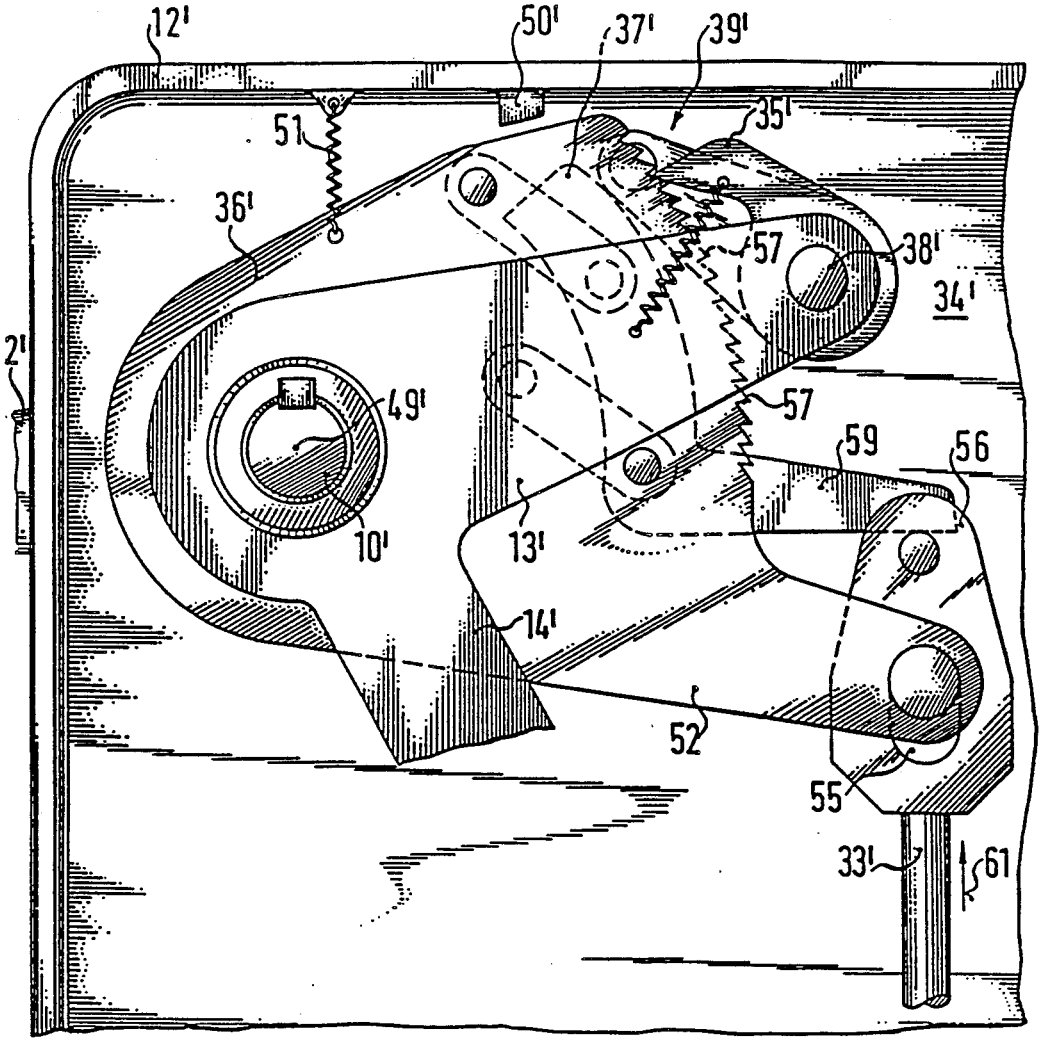
FIG. 4 is a view similar to FIG. 3, showing the device according to FIG. 3 in the coupled state.

The embodiment according to FIGS. 3 and 4 differs from the embodiment according to FIGS. 1 and 2 through the use of a differently constructed coupling 34'.

According to FIGS. 3 and 4, the winding frame 2' has a pivot axis 10' with an arm 13' which is fastened to the axis 10' and is directed backward, as well as a control arm 14' which is slanted downward.

The coupling 34' is formed of a first coupling element 35' in the form of a toothed pawl, a second coupling element 36' in the form of a toothed circular segment, and a control element 37' for separating and joining the coupling elements 35', 36'.

The toothed pawl 35' is supported at the arm 13' by means of a shaft 38', so that it can be tilted. A control element 39' formed of a lever 40' and a pin 41', is fastened at the shaft 38' adjacent the toothed pawl 35'. The control element 37' is in the form of an arcuate toothed pawl rejector which is disposed parallel to the toothed circular segment 36'. The toothed pawl rejector 37' is connected to the toothed circular segment 36' by a parallel displacement device 42. The parallel displacement device 42 is formed of two articulating pins 43, 44 at the circular segment 36', two articulating pins 45, 46 at the control element 37', and two parallel links 47, 48, which interconnect the articulating pins.

The toothed circular segment 36' is pivotably supported with its center 49' on the pivot axis 10' of the winding frame 2'. The position of the circular segment 36' is determined by a stop 50' which is connected to the housing 12'. A tension spring 51 pulls the circular segment 36' upward against the stop 50'. A projection 52 of the circular segment 36' is connected to the lifting element 33' by a joint 53. The joint 53 is formed by a pin 54 on the projection 52 which is engaged in an elongated hole 55 formed in a link 56 at the end of the lifting element 33'.

FIG. 3 shows that the teeth 57 of the circular segment 36' lie on a circular arc which has its center at reference numeral 49'. The edge 58 of the toothed pawl rejector 37' is also arcuate and has the same radius of curvature as the set of teeth 57.

The toothed pawl rejector 37' is provided with a horizontally directed operating lever 59, which lies on a pin 60 fastened to the link 56.

FIG. 3 relates to the winding operation. The coupling 34' is in the decoupled state. The lifting element 33' is raised in the direction of an arrow 61 high enough so that the toothed pawl rejector 37' prevents the engagement of the toothed pawl 35' in the teeth 57 of the circular segment 36'. This is effected by the pin 60 lifting the lever 59, so that the pawl rejector 37' rotates around the pins 43, 44 and is also lifted and simultaneously tilted forward. Accordingly, after the edge 58 contacts the pin 41', it moves the lever 40' clockwise, so that the pawl 35' which sits on the same shaft 38' becomes disengaged or remains disengaged from the teeth 57. This is done against the force of a tension spring 62 which always tends to engage the pawl 35' with the teeth 57.

The tension spring 62 connects the toothed pawl 35' with the arm 13'. The lifting element 33' is also lifted in the direction of the arrow 61, so that the tension spring 51 can move the circular segment 36' against the stop 50'.

During the winding of the cross-wound bobbin, the winding frame 2' slowly swings clockwise, so that the control arm 14' also moves clockwise.

When the cross-wound bobbin has reached the predetermined diameter, the following events take place:

According to the dimension of the elongated hole 55, the lifting element 33' moves downward against the direction of the arrow 61. This initially occurs without taking along the projection 52 and the circular segment 36'. The operating lever 59 and therefore the pawl rejector 37' follow the downward motion of the pin 60. The lever 59 and the pawl 35' thus swing counter clockwise due to the action of the tension spring 62, until the toothed pawl engages in the teeth 57 of the circular segment 36', as shown in FIG. 4. After the pawl 35' has engaged in the teeth 57, the pin 41' looses contact with the toothed pawl rejector 37'.

Meanwhile, the lifting element 33' moves further in the direction of the arrow 61, so that the arm 52, and with it the circular segment 36' are then also taken along. The circular segment 36' therefore swings clockwise around the center 49' and takes along the pawl 35' as well as the arm 13'. The arm and the winding frame move clockwise, so that the cross-wound bobbin is lifted from the drive drum. FIG. 4 shows that the circular segment 36' is already a small distance away from stop 50', so that considering the greater length of the winding frame 2', the bobbin is sufficiently lifted from its drive drum. The swinging motion is continued until the desired distance between cross-wound bobbin and the drive drum is reached.

Figure 5:
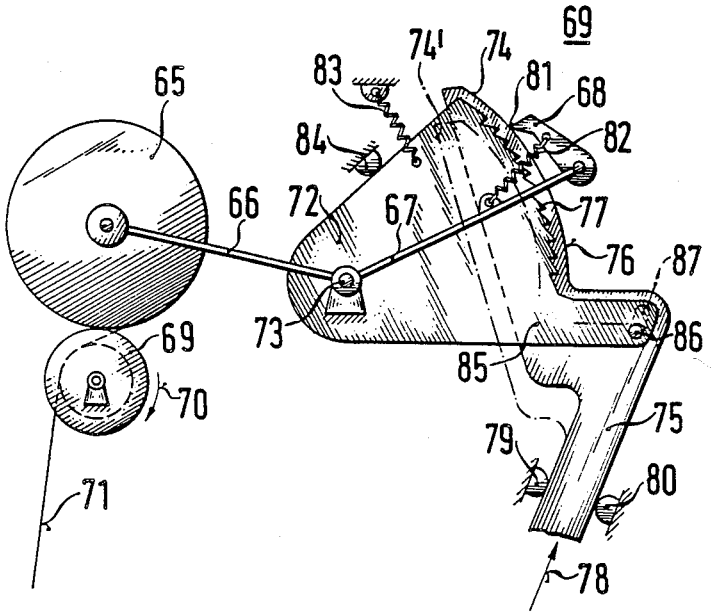
FIG. 5 is a fragmentary side-elevational view of another embodiment of the invention.

In the embodiment according to FIG. 5, the cross-wound bobbin 65 is rotatably supported on a winding frame 66. The winding frame 66 has an arm 67 which carries the toothed pawl 68 of the coupling 69. The cross-wound bobbin 65 lies on a drive drum 69 which rotates in the direction of an arrow 70 and drives the cross-wound bobbin by friction.

A thread 71 is therefore wound onto the crosswound bobbin 65. In this embodiment as well, the toothed circular segment 72 is rotatably supported on the pivot axis 73 of the winding frame 66. The toothed pawl rejector 74 is a fixed part of the lifting element 75 of the otherwise non-illustrated frame lifting device. The arcuate contour 76 of the toothed pawl rejector 74 has the same radius of curvature as the teeth 77 of the circular segment 72.

FIG. 5 shows the device during the winding operation. The lifting element 75 is guided in the direction of an arrow 78 through fixed guides 79, 80, and is pushed forward far enough so that the contour 76 extends beyond the teeth 77, as shown in FIG. 5. Since the toothed pawl 68 has a cutting or knife-edge 81, which has a dimension that is long enough so that it covers or overlaps the teeth 77 of the circular segment 72, as well as the pawl rejector 74, the toothed pawl 68 in this case directly contacts the contour 76 of the pawl rejector 74. The toothed pawl rejector 74 always acts directly on the edge 81 of the toothed pawl 68. The tension spring 82 presses the toothed pawl 68 onto the pawl rejector 74. Disregarding friction, the winding frame 66 is otherwise freely movable. The lifting element 75 is lifted so that the circular segment 72 lies against the fixed stop 84 under the action of a tension spring 83.

If the winding frame 66 with the cross-wound bobbin 65 which it carries, is to be lifted a certain distance from any given position, the lifting element 75 is retracted against the direction of the arrow 78. In this way the circular segment 72 retains its position initially because the pin 86 in the projection 85 engages in an elongated hole 87 in the lifting element 75.

As the lifting element 75 is retracted, the pawl rejector 74 reaches the position 74' indicated by dot-dash lines. The toothed pawl 68 is already engaged behind a tooth of the set of teeth 77. If the element 75 is further retracted against the direction of the arrow 78, the pin 86 reaches the top of the elongated hole 87 so that the circular segment 72 is lifted from the stop 84 against the force of the spring 83. The toothed pawl is thus taken along, so that the winding frame 66 is forced to tilt clockwise around the pivot axis 73.

The invention is not limited to the illustrated and described embodiments which were used as examples. For instance, the second embodiment of the invention could be varied by using a roller to reduce friction instead of the pin 41.

It is claimed:

1. In a winding device for cross-wound bobbins, including a winding frame rotatably supporting a bobbin, a drive drum for rotating the bobbin, and a drive for rotating the drive drum, the improvement comprising an apparatus for automatically lifting the bobbin from the drive drum upon the stoppage of the drive, said lifting apparatus including a disconnection device being connected to the drive, means for switching said disconnection device into different switching states for controlling the drive drum, a device for lifting the winding frame being connected to said disconnection drive, means for controling said frame lifting device in dependence on the switching state of said disconnection device, and a coupling having a first coupling element connected to the winding frame, a second coupling element connected to said frame lifting device, and a control element, said frame lifting device including means connected to said control element for separating and joining said coupling elements with said control element.

2. Apparatus according to claim 1, wherein said coupling elements have sets of teeth engageable with each other.

3. Apparatus according to claim 2, wherein said first coupling element is a pivotable toothed pawl, said second coupling element is a toothed circular segment, and said control element is an arcuate toothed pawl rejector disposed parallel to said circular segment.

4. Apparatus according to claim 3, wherein said frame lifting device includes a lifter element connected to said toothed pawl rejector, the winding frame has a pivot axis, said toothed circular segment has a center pivotally supported at the pivot axis of the winding frame, and including a joint connecting said toothed circular segment to said lifter element.

5. Apparatus according to claim 4, wherein the winding frame includes an arm facing away from the bobbin on which said toothed pawl is pivotably supported; said coupling including means for lifting said lifter element during winding of the bobbin so far that said toothed pawl rejector prevents engagement of said toothed pawl in said teeth of said circular segment; and including means for lowering said lifter element after the drive stops so far that said toothed pawl rejector is nonfunctional, said toothed pawl is engaged in said teeth of said circular segment, and said winding frame is lifted to a raised position and the bobbin is brought out of contact with the drive drum, due to the connection between the lifter element and said arm.

6. Apparatus according to claim 3, wherein said toothed pawl has a knife-type edge covering the teeth of said circular segment and said toothed pawl rejector, permitting said toothed pawl rejector to directly contact said toothed pawl.

7. Apparatus according to claim 3, including another control element disposed alongside and connected to said toothed pawl, said other control element contacting said toothed pawl rejector upon operation of said toothed pawl rejector.

8. Apparatus according to claim 3, including a parallel displacement device connecting said toothed pawl rejector to said toothed circular segment and said toothed pawl rejector has a lever contacting said frame lifting device.

* * * * *